United States Patent [19]

Pitts et al.

[11] 4,280,731

[45] Jul. 28, 1981

[54] RESTRAINING DEVICE FOR WHEELCHAIRS AND THE LIKE

[75] Inventors: William M. Pitts, 3266 E. Scarborough Rd., Cleveland Heights, Ohio 44118; Don Herron, Willoughby, Ohio

[73] Assignee: William M. Pitts, Cleveland, Ohio

[21] Appl. No.: 103,045

[22] Filed: Dec. 13, 1979

[51] Int. Cl.[3] ..... A47C 15/00; A62B 35/00

[52] U.S. Cl. ..... 297/487; 297/DIG. 4; 297/488

[58] Field of Search ..... 297/488, 487, 254, 216, 297/DIG. 4, 423, 429, 427, 468, 42, 45, 464, 466; 280/748, 751

[56] References Cited

U.S. PATENT DOCUMENTS

| | | | |
|---|---|---|---|
| 2,717,162 | 9/1955 | Walters | 280/748 |
| 2,755,101 | 7/1956 | Budde | 280/748 |
| 2,833,554 | 5/1958 | Ricordi | 297/488 X |
| 3,635,526 | 1/1972 | Posey | 297/488 |
| 4,054,319 | 10/1977 | Fogg, Jr. et al. | 297/DIG. 4 |
| 4,065,180 | 12/1977 | Karay | 297/DIG. 4 |

FOREIGN PATENT DOCUMENTS

| | | | |
|---|---|---|---|
| 969883 | 5/1950 | France | 297/466 |

*Primary Examiner*—James T. McCall
*Attorney, Agent, or Firm*—Isler and Ornstein

[57] ABSTRACT

A restraining device for wheelchairs is disclosed consisting of a plurality of restraining bars for removable attachment to conventional wheelchairs, and designed to prevent an occupant of the wheelchair from moving himself or herself therefrom, or from moving his or her legs and body forwardly in the chair to an undue extent, while allowing sufficient freedom of movement to make the occupant comfortable. The restraining bars are adjustable, both singly and in unison, to various positions in relation to the wheelchair and occupant.

9 Claims, 12 Drawing Figures

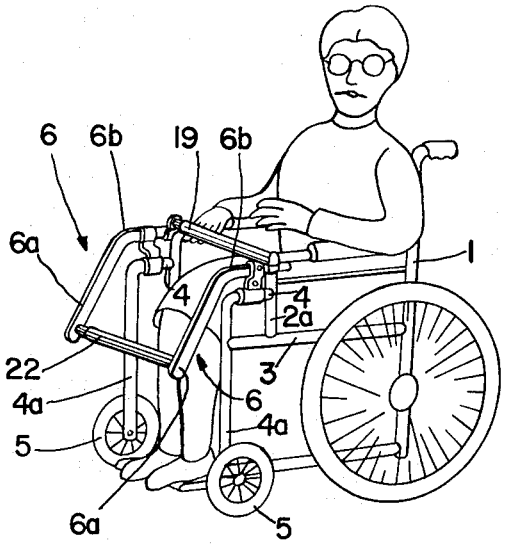
Fig. 1
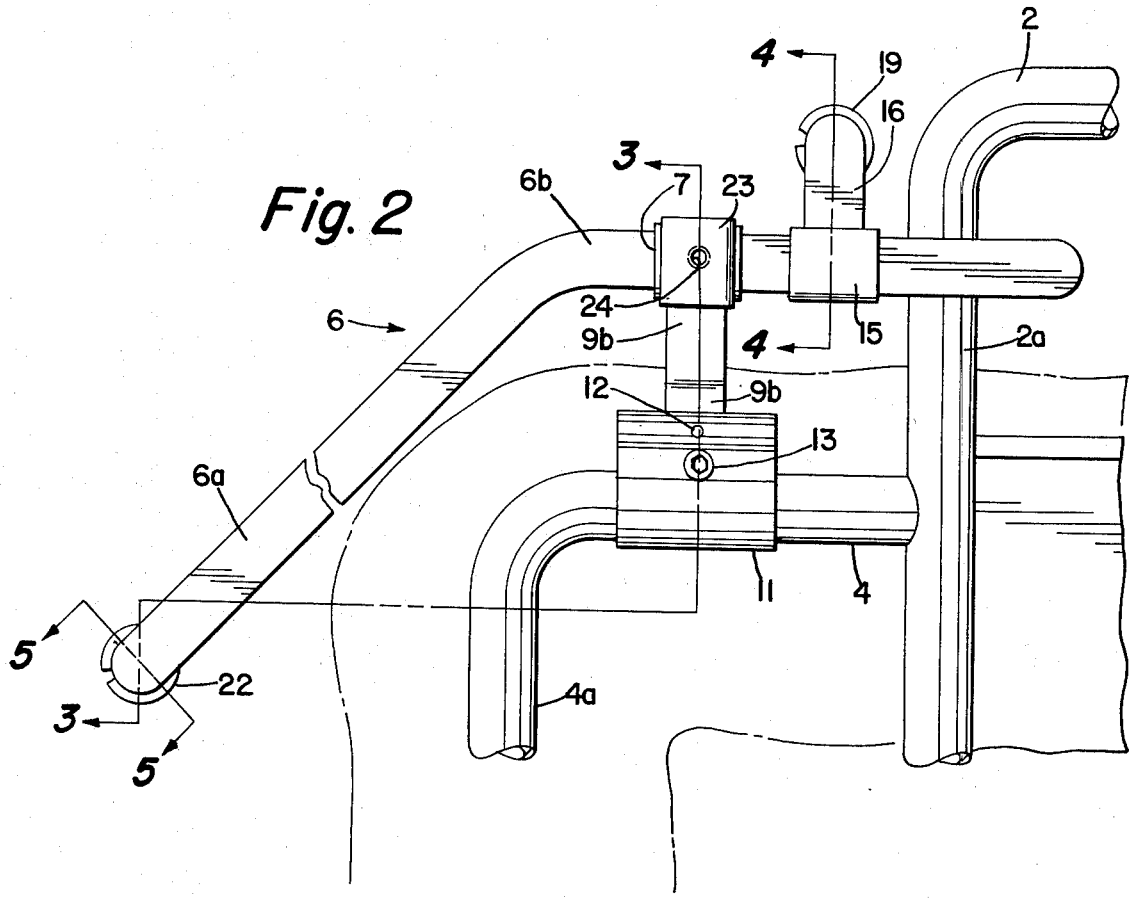

RESTRAINING DEVICE FOR WHEELCHAIRS AND THE LIKE

BACKGROUND OF THE INVENTION

In U.S. Pat. No. 3,619,005, a wheelchair is disclosed, having side arm members to which a restraining device is removably attached.

The restraining device is designed to prevent patients sitting in the chair from falling out and injuring themselves, and comprises a pair of identical elongated brackets, each having a plurality of longitudinally-spaced openings sized for loosely receiving the ends of a restraining bar member, the bar member being then locked to the brackets by means of spring locks or padlocks.

Although the restraining bar of that patent is adjustable relatively to the body of a patient seated in the chair, the range of such adjustment is limited; the bar is not vertically adjustable, nor is it adjustable in length to accommodate it to fit wheelchairs of different widths, nor does it afford restraint to movement of the part of the patient's body or the legs of the patient, so that the patient can, under certain conditions, slide downwardly in the wheelchair and forwardly under the restraining bar and onto the floor.

The device, moreover, provides little or no posture-inducing support for patients in such wheelchairs, which has been found to be a virtual necessity for paraplegics and quadriplegics.

The device of said patent furthermore, requires a certain degree of skill in assembling the restraining bar with the brackets, and securing the brackets to the arms of the wheelchair, all of which is time-consuming.

SUMMARY OF THE INVENTION

The invention has as its primary object, the provision of a restraining device of the character described which comprises restraining bars which are adjustable relatively to the body of the occupant of a wheelchair, and which have a wide range of adjustment.

Another object of the invention is to provide a restraining device of the character described, comprising restraining bars which are vertically adjustable relatively to the body of the occupant of the wheelchair, and adjustable in width to accommodate them to fit wheelchairs of different widths.

Another object of the invention is to provide a restraining device of the character described, which is designed to afford restraint to the occupant's body to prevent him from removing himself from the wheelchair and to prevent movement of his body and legs, to keep him from sliding downwardly in the wheelchair and forwardly onto the floor as well as preventing excessive compression to his chest resulting in suffocation as can be experienced by use of conventional web strapping restraining devices.

A further object of the invention is to provide a restraining device of the character described which provides posture-inducing support for occupants of the wheelchair, and is particularly useful for paraplegics and quadriplegics.

A still further object of the invention is to provide a restraining device of the character described, which consists of a minimum number of parts, which can be easily manufactured, and assembled virtually without the aid of tools, and by unskilled personnel.

The foregoing and other features and objects of the invention and the manner of attaining them will become more apparent and the invention itself will be best understood by reference to the following description of an embodiment of the invention taken in conjunction with the accompanying drawings.

BRIEF DESCRIPTION OF THE DRAWINGS

The present invention may be better understood and the numerous objects and advantages will become apparent to those skilled in the art by reference to the accompanying drawings wherein like reference numerals refer to like elements in the various figures and in which:

FIG. 1 is a perspective view of parts of a conventional so-called "desk arm" wheelchair and a patient sitting therein, showing the restraining device of the invention;

FIG. 2 is a fragmentary side elevational view, on an enlarged scale of the wheelchair and restraining device shown in FIG. 1;

DESCRIPTION OF A PREFERRED EMBODIMENT

Figure 3:
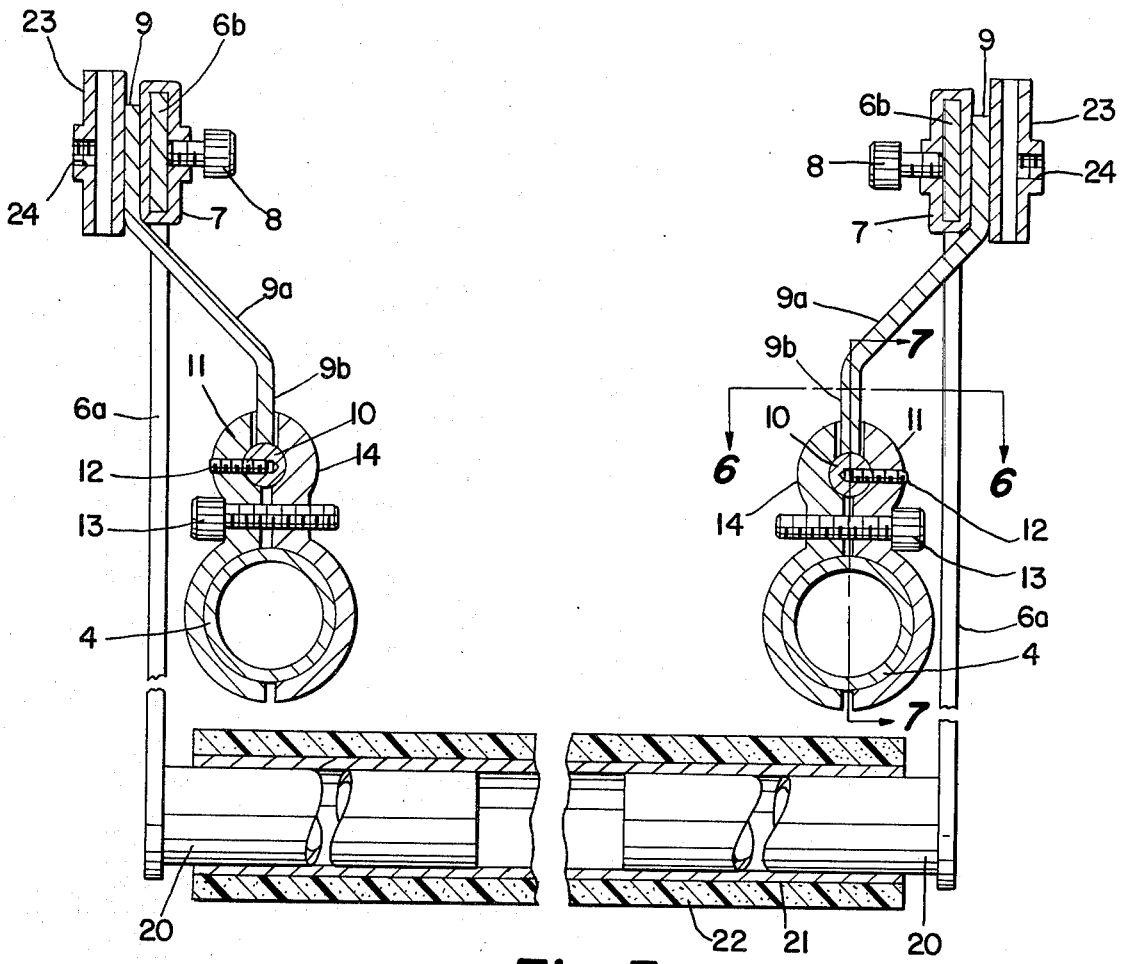
FIG. 3 is a fragmentary cross-sectional view on an enlarged scale taken on the line 3—3 of FIG. 2.
Figure 4:
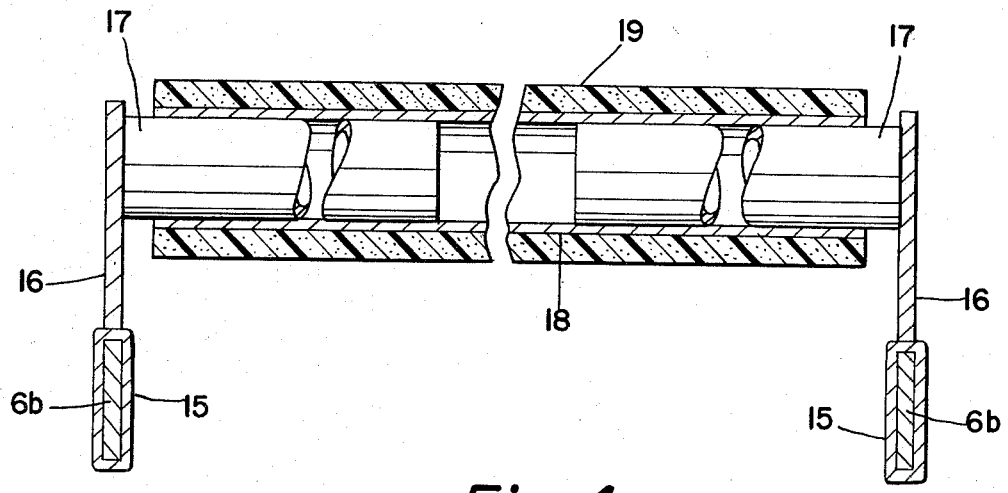
FIG. 4 is a fragmentary cross-sectional view on an enlarged scale taken on the line 4—4 of FIG. 2.
Figure 5:
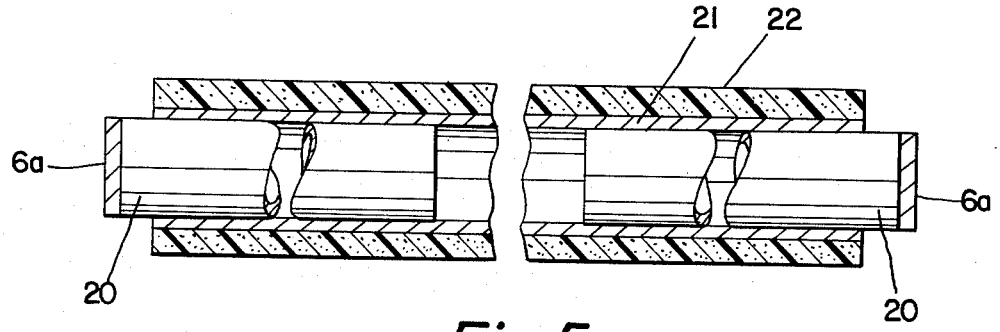
FIG. 5 is a fragmentary cross-sectional view on an enlarged scale taken on the line 5—5 of FIG. 2.

Referring more particularly to FIGS. 1, 2, 3, 4, 5, 6 and 7 of the drawings, a conventional wheelchair of the so-called "desk arm" type is illustrated, such for example, as the portable folding wheelchair manufactured by Everest-Jennings.

The chair comprises a frame formed of tubular steel or other metallic members comprising laterally-spaced members 1, to which a back-support (not shown) is attached, laterally-spaced members 2 extending forwardly from the members 1 and providing arm supports for a patient seated in the chair, and laterally-spaced members 3, which extend forwardly from the members 1 to which a seat (not shown) is attached.

The members 2 are bent downwardly at their forward ends to provide vertical components **2*a* which extend to and are secured to the members 3**.

The so-called "desk arm" type chair further includes laterally-spaced arm extension members 4 which are offset downwardly from the members 2 and extend forwardly from the components **2*a* of the members 2** and are bent downwardly at their forward ends to provide vertical components 4a, to which the forward wheels 5 of the wheelchair are secured. The components 4a are secured to the forward ends of the members 3.

The restraining device of the present invention comprises a pair of laterally-spaced side bars 6, 6, of identical configuration, each formed of flat steel bar stock to provide a portion 6a which extends forwardly and downwardly at an angle of approximately 45 degrees to the horizontal, and a rearward portion 6b which extends horizontally at an angle of approximately 135 degrees to the portion 6a.

It is noted that the side bars 6, 6 are disposed in vertical planes which are laterally outward of the members 2 and 4 of the wheelchair frame.

Mounted on the portions 6b of the side bars 6, for adjustable slidable movement along these portions, are loop members 7 of rectangular cross-section, which in adjusted position are locked to the portions 6b by means of socket head Allen screws 8.

Welded or otherwise secured to the outboard faces of the loop members 7 are bracket members 9, each having an inwardly inclined portion 9a and a downwardly extending portion 9b, lying in a vertical plane offset inwardly from and parallel with the plane of the member 9.

Figure 6:
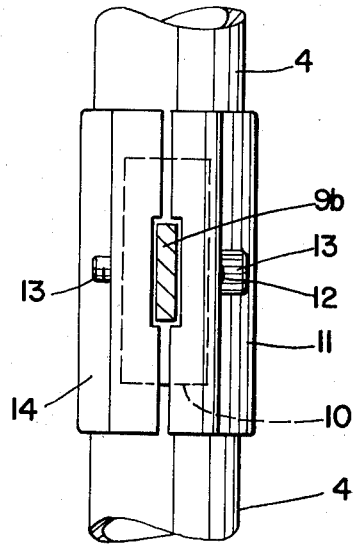
FIG. 6 is a fragmentary cross-sectional view taken on the line 6—6 of FIG. 3.
Figure 7:
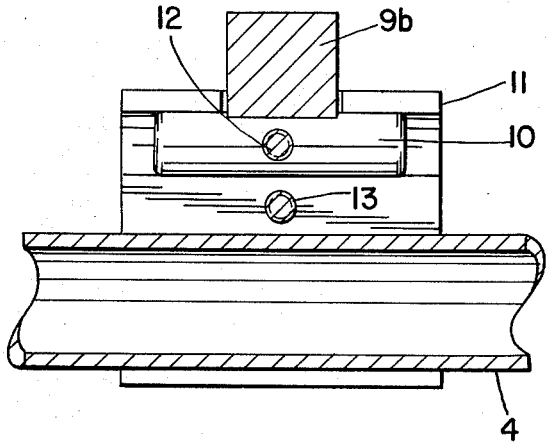
FIG. 7 is a fragmentary cross-sectional view taken on the line 7—7 of FIG. 3.

As best seen in FIGS. 3, 6 and 7, the lower ends of the portions 9b of the bracket members 9 are welded or otherwise secured to pins 10 to which clamp members 11 are secured, as by screws 12.

Secured to the clamp members 11, as by means of socket head Allen screws 13, are clamp members 14, similar to the clamp members 11 and which coact with the latter for clamping engagement with the arm extension members 4.

The clamp members 11 and 14 thus serve as a means of supporting the side bars 6 of the restraining device on the wheelchair frame.

By loosening the screws 13, the clamp members 11 and 14 and accordingly the side bars 6, may be moved to any desired position in relation to the wheelchair frame.

Mounted on the portions 6b of the side bars 6 for adjustable slidable movement along these portions, are loop members 15 of rectangular cross-section.

Welded or otherwise secured to the upper ends or faces of the loop members 15, are upstanding supports 16 each formed of flat steel bar stock and having secured to its upper end, at the inboard face thereof, a tubular member 17.

The tubular members 17 are telescopically slidable in the ends of a tubular restraining bar 18, which is provided with a tubular covering 19 of a protective material, such for example, as foam rubber, polyurethane, or the like.

By having the tubular members 17 telescopically slidable in the ends of the restraining bar 18, the spacing between the supports 16 may be adjusted, depending on the width of the wheelchair or the distance between the arm extension members 4.

The restraining bar 18-19 may be adjusted to any desirable position in relation to the body of the patient seated in the wheelchair, depending on the weight and size of the patient, but in general, is designed to be moved to a position adjacent the waist of the patient, but spaced sufficiently from the waist to make the patient comfortable.

In FIG. 2, the legs of a patient seated in the wheelchair are shown in broken lines, and the restraining bar 18-19 is shown as in a position slightly above the legs. Such a position of the restraining bar prevents the patient from moving his or her body forwardly in the chair to an undue extent, yet allows sufficient freedom of movement of the arms and some forward movement of the head.

As best seen in FIGS. 1, 2, 3 and 5, the portions 6a of the side bars 6 have welded or otherwise secured to the inboard faces of the lower ends thereof, tubular-members 20.

The tubular members 20 are telescopically slidable in the ends of a tubular restraining bar 21 which is provided with a tubular covering 22 of a protective material, such for example, as foam rubber, polyurethane or the like.

By having the tubular members 20 telescopically slidable in the ends of the restraining bar 21, the spacing between the side bars 6 may be adjusted, depending on the width of the wheelchair or the distance between the arm extension members 4.

The restraining bar 21-22 may be adjusted to any desirable position in relation to the legs of a patient seated in the chair, by adjustment of the clamp members 11 and 14 relatively to the arm extension members 4 and/or adjustment of the side bars 6 relatively to the bracket members 9, but in general, is designed to be moved to a position adjacent the legs or knees of the patient, but spaced sufficiently from the legs or knees to make the patient comfortable.

In FIG. 2, the legs of a patient seated in the wheelchair are shown in broken lines, and the restraining bar 21-22 is shown as in a position approximately midway between his knees and feet. Such a position of the restraining bar prevents the patient from moving the legs forwardly in the chair to an undue extent, yet allows slight freedom of movement of the legs, without permitting the patient to slide downwardly in the wheelchair and forwardly under the restraining bar and onto the floor.

The conjoint action of the two restraining bars is such as to provide a posture-inducing support for the patient in the wheelchair, which support has been found to be particularly beneficial for paraplegics and quadriplegics.

It may be noted that the restraining device is such as to require a minimum of parts which can be easily manufactured and assembled, and can be attached to a wheelchair with a minimum of effort.

All adjustments can be quickly and easily effected with a simple tool, such as a small Allen wrench.

Referring to FIGS. 2 and 3, it will be seen that the outboard faces of the bracket members 9 have welded or otherwise secured thereto loop members 23, of rectangular cross-section, similar to the loop members 7, but oriented in a direction 90 degrees to the direction of orientation of the latter.

Figure 10:
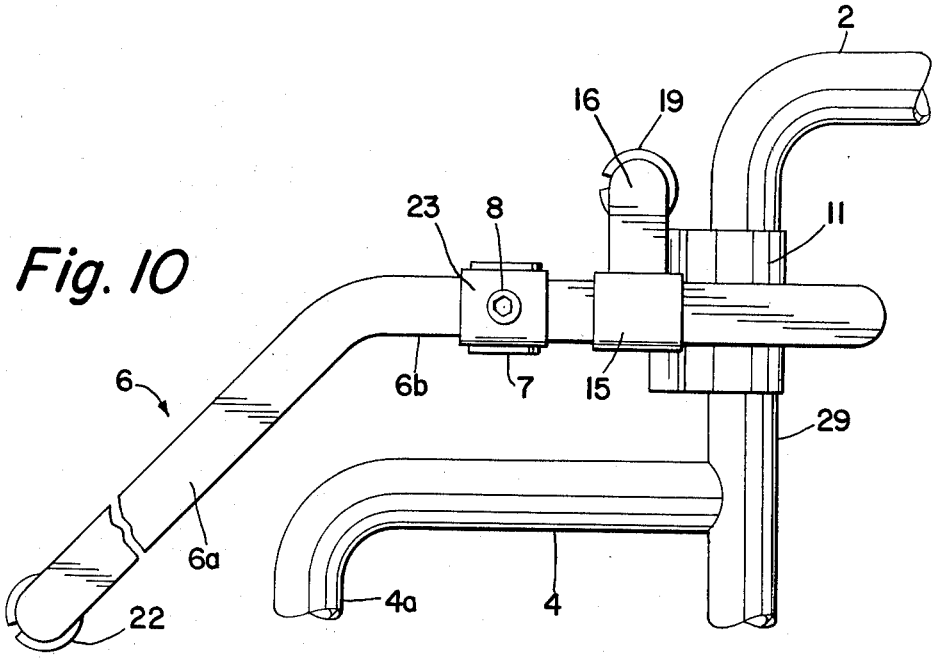
FIG. 10 is a view similar to FIG. 2, but showing the restraining device secured to a different part of desk type wheelchair.

The loop members 23 are utilized when the restraining device is clamped to the wheelchair in the manner shown in FIG. 10.

In FIG. 10, the portions 6b of the side bars 6 are passed through the loop members 23 and the loop members are locked to the side bars by means of the socket head Allen screws 8, which are removed from the loop members 7 and inserted into the threaded openings 24 of the loop member 23.

The clamp members 11 and 12 are clamped to the vertical components *2a* of the wheelchair frame. By clamping the device to these vertical components, instead of the members 4, as in FIGS. 2 and 3, a means is provided for vertical adjustment of the entire restraining device relatively to the wheelchair frame.

The use of socket head Allen screws requires a small socket wrench for tightening and loosening the screws 8 and screws 13.

Figure 8:
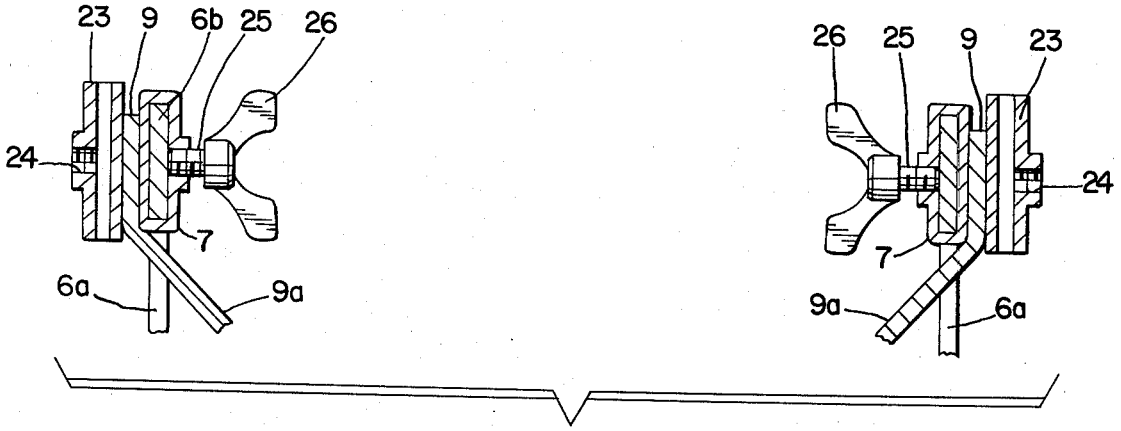
FIG. 8 is a view of a portion of FIG. 3, but showing a modified form of clamping screw.

In FIG. 8 of the drawings, a modification is shown in which the need for such a socket wrench is obviated through the use of screws 25 having heads 26 of the wing type, which may be manually manipulated for tightening and loosening the screws.

Figure 9:
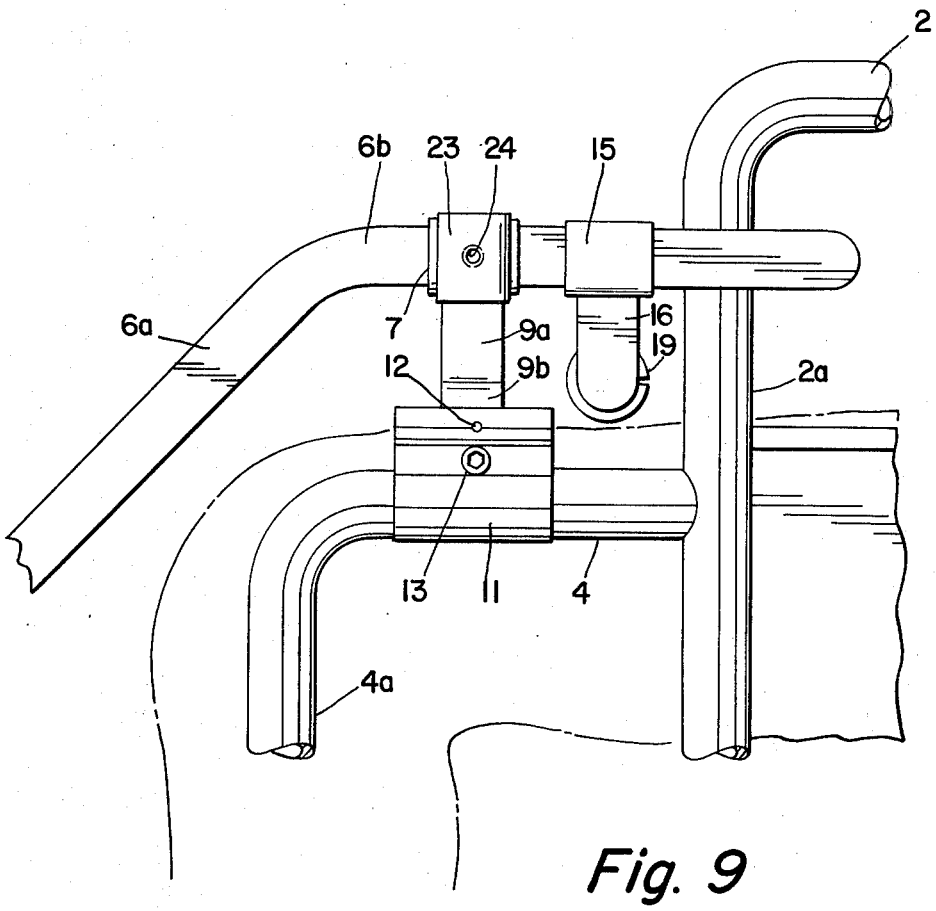
FIG. 9 is a view similar to FIG. 2, but showing the upper restraining bar in a different position in relation to the side bars.

In FIG. 9 of the drawings, the position of the restraining bar 19 is shown as in a reversed relationship to that shown in FIG. 2, for the purpose of positioning the bar closer to the legs or thighs of the patient.

Figure 11:
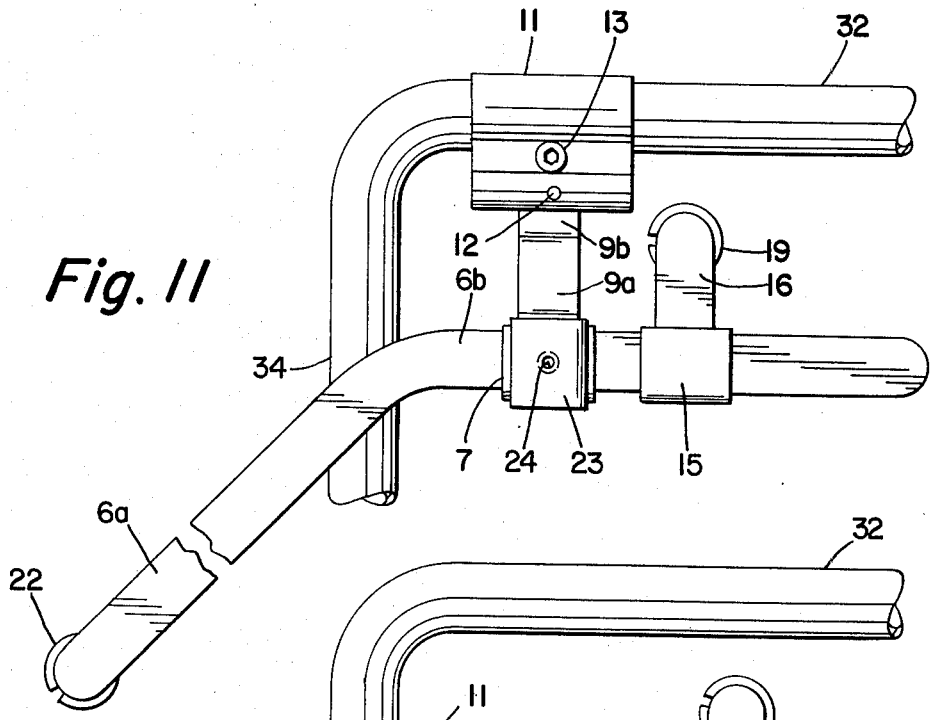
FIG. 11 is a view similar to FIG. 2, but showing the restraining device secured to a so-called "full arm" wheelchair.
Figure 12:
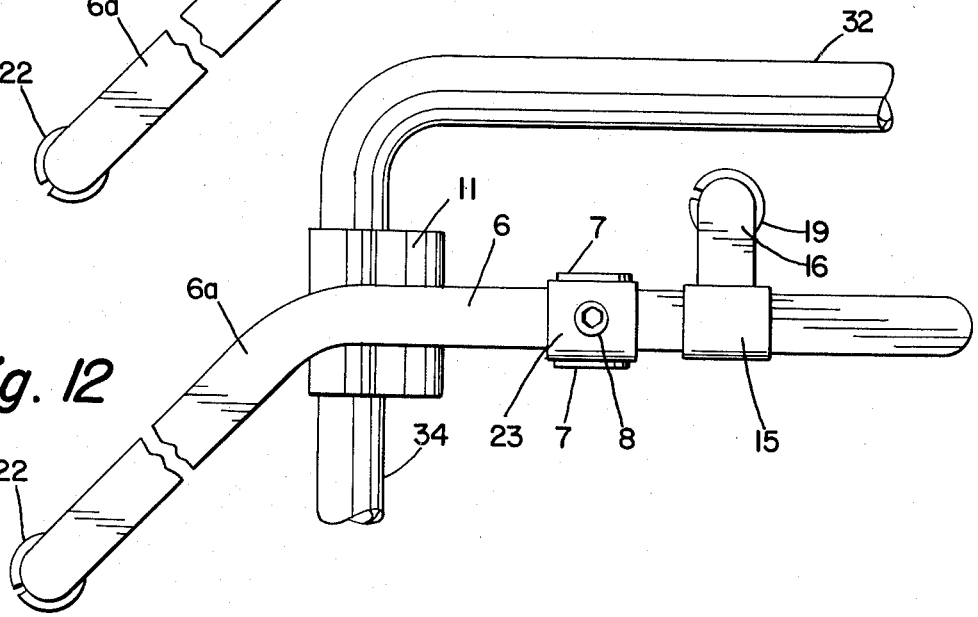
FIG. 12 is a view similar to FIG. 11, but showing the restraining device secured to a different part of the wheelchair.

In FIGS. 11 and 12 of the drawings, the use of the restraining device for wheelchairs of the so-called "full arm" type is illustrated.

In such chairs, the frame members 32 which correspond to the frame members 2 in FIG. 2, are extended and bent downwardly at their forward ends to provide the vertical components 34, which correspond to the vertical components *4a* in FIG. 2, it being understood that the parts *2a* and 4 of the frame shown in FIG. 2 are omitted in such a "full arm" wheelchair.

In FIG. 11, the restraining device of FIGS. 2 and 3 is shown as clamped to the members 32 of the wheelchair frame, in the same manner that the device is clamped to the members 4 shown in FIG. 2, it being noted, however, that the position of the bracket members 9 and clamp members 11 in relation to the side bars 6 is 180 degrees from that shown in FIG. 2.

In FIG. 12, the restraining device of FIGS. 2 and 3 is shown as clamped to the vertical components 34 of the wheelchair frame, in the same manner that the device is clamped to the vertical components *2a* shown in FIG. 10, it being noted, however, that the position of the bracket members 9 and clamp members 11 in relation to the loop members 23, is 180 degrees from that shown in FIG. 10.

In the arrangements shown in FIGS. 11 and 12, it will be seen that both restraining bars are independently adjustable in relation to the wheelchair frame, as well as conjointly adjustable in relation thereto.

It is thus seen that we have provided a restraining device for wheelchairs which comprises restraining bars which are adjustable relatively to the body of the occupant of the wheelchair, which have a wide range of adjustment, which are vertically adjustable and are adjustable to accommodate them to fit wheelchairs of different widths.

It is also seen that we have provided a restraining device for wheelchairs which is designed to afford restraint to movement of the occupant's body and legs, whereby to prevent the occupant from sliding downwardly in the wheelchair and forwardly onto the floor, and at the same time preventing him from removing himself from the wheelchair, yet giving him freedom of body movement which obviates the feeling of being forceably tied to the wheelchair.

It is also seen that we have provided a restraining device for wheelchairs which provides posture-inducing support for occupants of the wheelchair, and is particularly useful for paraplegics and quadriplegics.

It is further seen that we have provided a restraining device which consists of a minimum number of parts which can be easily manufactured and assembled virtually without the aid of tools, and by unskilled personnel.

While there has been described above the principles of this invention in connection with a specific embodiment of the invention, it is to be clearly understood that this description is made only by way of example, and not as a limitation to the scope of the invention.

Having thus described my invention, I claim:

1. In combination with a wheelchair having a back support and laterally-spaced members extending forwardly from said back support and adapted to confine therebetween a patient seated in the chair against movement in a direction laterally of the chair, said members having portions providing arm supports for said patient, clamps removably secured to said members, laterally-spaced side bars supported by said clamps, each of said side bars having a rearwardly extending horizontal portion and a downwardly and forwardly extending portion, a first restraint bar supported by said rearwardly extending portions of said side bars and adapted to confine the upper portion of the patient's body against undue forward movement in said chair, and a second restraint bar substantially parallel with said first restraint bar and supported by said forwardly and downwardly extending portions of said side bars and adapted to confine the legs of said patient against undue forward movement relatively to said chair.

2. The combination as defined in claim 1, wherein said side bars are adjustably movable to desired positions in relation to said wheelchair.

3. The combination as defined in claim 1, wherein said first restraint bar is adjustably movable along the horizontal portions of said side bars.

4. The combination as defined in claim 1, wherein said members have arm extensions and said clamps are secured to said arm extensions.

5. The combination as defined in claim 1, wherein said members have vertical components and said clamps are secured to said vertical components.

6. The combination as defined in claim 1, wherein said side bars are disposed in vertical planes spaced laterally outward of the planes of said members.

7. A restraining device for a wheelchair or the like, said device comprising a pair of laterally-spaced side bars, each of said side bars having a rearwardly extending horizontal portion and a downwardly and forwardly extending portion, a first restraint bar supported by said rearwardly extending portions of said side bars, and adapted to confine the upper portions of the body of an occupant of said chair against undue forward movement of said chair, and a second restraint bar substantially parallel with said first restraint bar, and supported by said forwardly and downwardly extending portions of said side bars and adapted to confine the legs of said occupant against undue forward movement relatively to said chair.

8. A restraining device as defined in claim 7, including means supported by said side bars for supporting said side bars on the frame of a wheelchair, said supporting means comprising clamp members adapted to be clamped to portions of said wheelchair frame.

9. A restraining device as defined in claim 8, wherein said clamp members are selectively movable to a position in alignment with said horizontal portions of said side bars or into a position perpendicular to said horizontal portions of said side bars.

* * * * *